United States Patent [19]

Heijnen

[11] Patent Number: 4,682,975

[45] Date of Patent: Jul. 28, 1987

[54] MACHINE AND METHOD FOR SETTING-UP BASKET STYLE ARTICLE CARRIERS

[75] Inventor: Johannes A. Heijnen, Bergen Op Zoom, Netherlands

[73] Assignee: The Mead Corporation, Dayton, Ohio

[21] Appl. No.: 856,890

[22] Filed: Apr. 28, 1986

[30] Foreign Application Priority Data

Apr. 27, 1985 [GB] United Kingdom ..... 8510755

[51] Int. Cl.[4] ..... B31B 1/12; B31B 1/78

[52] U.S. Cl. ..... 493/123; 493/138; 493/312; 493/313; 493/315; 493/909

[58] Field of Search ..... 493/123, 125, 312, 313, 493/315, 316, 317, 319, 909, 138, 912; 271/11, 102

[56] References Cited

U.S. PATENT DOCUMENTS

| | | | |
|---|---|---|---|
| 2,780,970 | 2/1957 | Gentry | 493/313 |
| 2,811,087 | 10/1957 | Negrelli | 493/313 |
| 3,343,466 | 9/1967 | Sherman | 493/312 |

*Primary Examiner*—Frederick R. Schmidt
*Assistant Examiner*—Robert Showalter
*Attorney, Agent, or Firm*—Erwin Doerr

[57] ABSTRACT

A machine (10) for erecting article carriers (C) of the basket type comprises feeder assembly (34; 62) for withdrawing from a supply (20) and depositing the carriers in flat, folded condition one after the other in a feed path (F), flight bars for feeding (22) each carrier to an erecting station (E) at which means suction cups (96) are provided for moving apart opposite side walls of the carrier to bring it into set-up condition and locking arms (100) operable on a base panel (b) of the carrier to move the base panel into engagement with panel retaining elements (h) provided by the carrier, thereby to locate the base panel in a position in which it discourages collapse of the set-up carrier.

4 Claims, 9 Drawing Figures

MACHINE AND METHOD FOR SETTING-UP BASKET STYLE ARTICLE CARRIERS

This invention relates to a machine and a method for setting up basket style article carriers or similar containers from a flat folded condition into an erected condition preparatory to loading.

One aspect of the invention provides a machine for erecting article carriers of the basket type which machine comprises means for withdrawing from a supply and depositing the carriers in flat, folded condition one after the other in a feed path, means for feeding each carrier to an erecting station at which means are provided for moving apart opposite side walls of the carrier to bring it into set-up condition and locking means operable on a base panel of the carrier to move the base panel into engagement with panel retaining elements provided by the carrier thereby to locate the base panel in a position in which it discourages collapse of the set up carrier. According to a feature of this aspect of the invention means may be provided for engagement with opposite edges of the flat, folded carrier to guide the carrier in an upright attitude between said withdrawing means and said erecting means.

According to another feature of this aspect of the invention the locking means may comprise a main locking arm pivotal in a direction opposing the feed direction of the carrier to move the base panel of the carrier so that one end edge thereof is located in engagement with a locking element adjacent the trailing end of the carrier and a secondary locking arm pivotal in the same opposing direction to move the base panel into a position in which its opposite end edge can move into engagement with a locking element adjacent the leading end of the carrier so that when the locking arms are moved out of engagement with the base panel, the base panel is located by both said locking elements. In construction where this feature is adopted, the secondary locking arm may be pivotal and resiliently movable relative to the main locking arm.

In some constructions, pivotal movement of the secondary locking arm relative to the main locking arm may be cam-controlled so that the secondary locking arm trails the main locking arm and extends an upward force against the base panel of the carrier adjacent its leading end. Where this feature is adopted the main locking arm may be rotatably mounted so that its free end describes a circular path and the secondary locking arm may carry a follower engaged for movement about a fixed eccentric cam track.

Another aspect of the invention provides a method of erecting a basket style carrier which method comprises the steps of withdrawing successive carriers from a supply and depositing the carriers in flat, folded condition one after the other in a feed path, conveying each carrier to an erecting station, moving apart the opposite walls of the carrier to bring it into set up condition and moving the base panel into engagement with panel retaining elements provided by the carrier thereby to locate the base panel in a position in which it discourages collapse of the set-up carrier.

According to a feature of this aspect of the invention the carrier may be conveyed along the feed path in upright attitude between the withdrawal and setting-up steps.

An embodiment of the invention will now be described, by way of example, with reference to the accompanying drawings, in which.

Figure 1:
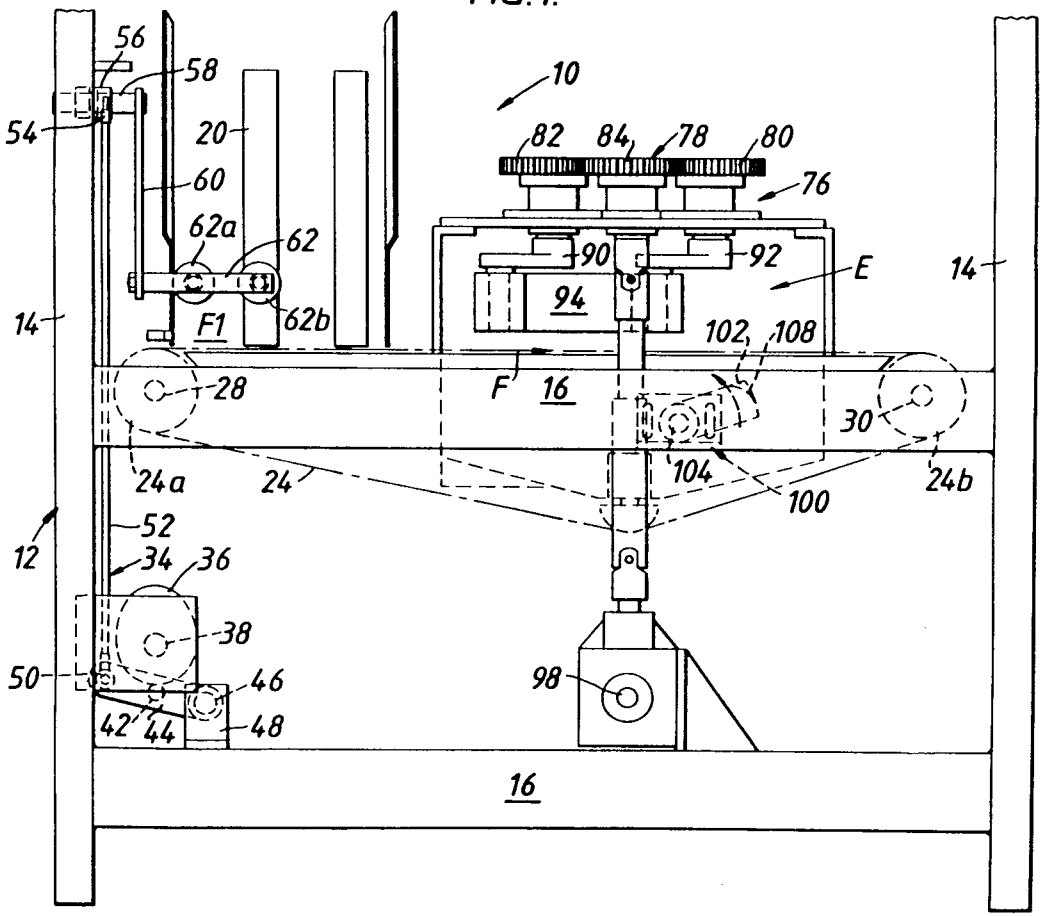
FIG. 1 is a side elevation of a machine according to the invention.
Figure 2:
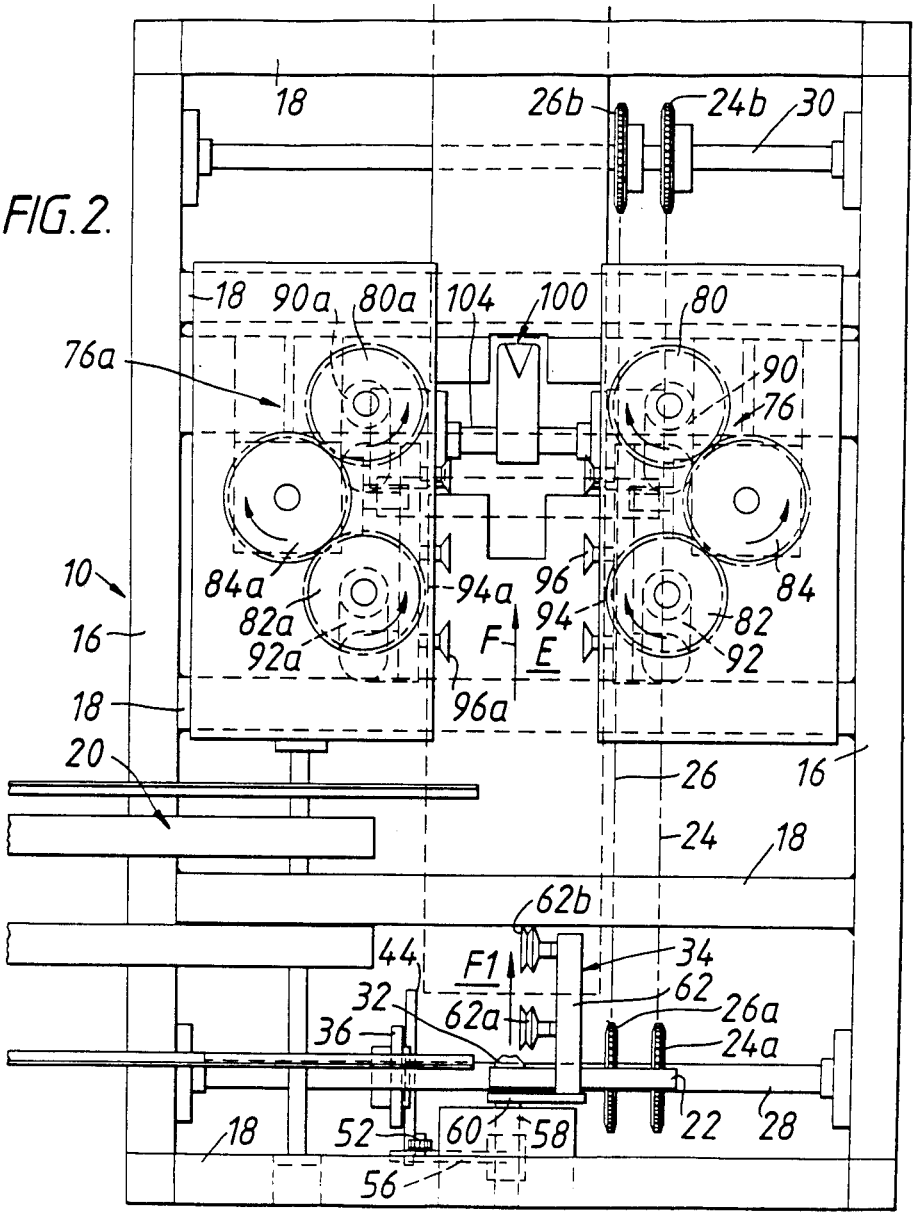
FIG. 2 is a plan elevation of the machine shown in FIG. 1.

Referring to the drawings, the carton opening machine 10 has a generally rectangular support frame 12 comprising upright members 14, longitudinal members 16 and transverse members 18.

An inclined hopper 20 which, in use, is loaded with a supply of basket-style article carriers 'C' in collapsed condition is located at the infeed end of the machine adjacent the main feed path 'F' of the machine.

Carriers 'C' are withdrawn sequentially from the hopper and deposited in upright flat-folded condition at the upstream end 'F1' of the feed path from whence they are conveyed to a carrier erecting station 'E' adjacent the downstream end of the feed path. In order to convey the carriers along the feed path a series of flight bars 22 are mounted on parallel endless chains 24, 26 which are entrained about upstream sprockets 24*a*, 26*a* and downstream sprockets 24*b*, 26*b*. Sprockets 24*a*, 26*a* are fixed for rotation with shaft 28 journalled at each of its ends to opposed longitudinal members 16 of the frame. Likewise sprockets 24*b*, 26*b* are fixed for rotation with shaft 30 also journalled at each of its opposite ends to longitudinal members 16, 16'. Each flight bar is fixed to chains 24, 26 adjacent one of its ends and has a free end which interferes with the feed path F. The free end of the flight bar carries a pusher block 32 which engages the trailing edge of a collapsed carrier deposited in the upstream end 'F1' of the feed path to convey the carrier along the feed path.

For withdrawing carriers from the hopper 20, a pivotal suction cup assembly 34 is provided at the infeed end of the machine. Assembly 34 comprises, at its lower end, an eccentric cam disc 36 fixed on rotatable shaft 38. Shaft 38 is driven from rotatable shaft 28 by sprockets 28*c*, 38*a* and connecting chain 40. Cam disc 36 acts on a follower 42 mounted intermediate the ends of a lower pivotal link 44. One end of link 44 is pivotal about pivot 46 on bracket 48 and its opposite end is hinged at 50 to the lowermost end of connecting rod 52. At its uppermost end the connecting rod is hinged at 54 to one end of upper pivotal link 56 whose other end carries stub shaft 58. A further link 60 depends downwardly from the free end of stub shaft 58 from which link extends a suction cup arm 62. Suction cup arm 62 extends partially across the lower face of hopper 20 and carries suction cups 62*a*, 62*b* respectively, each of which is pneumatically connected to a source of vacuum. When the eccentric cam disc 36 rotates so as to pivot link 44 in a direction which moves the connecting rod 52 downwardly, link 60 and its suction cup arm swing towards the hopper so that the suction cups engage the leading collapsed carrier in the hopper, whereupon suction is applied. Further rotation of the cam disc 36 pivots link 44 so as to move connecting rod 52 upwardly thereby to withdraw the suction cup arm away from the hopper. Thus, the engaged collapsed carrier is brought into position 'F1' of the feed path whereat suction is relieved.

Figure 3:
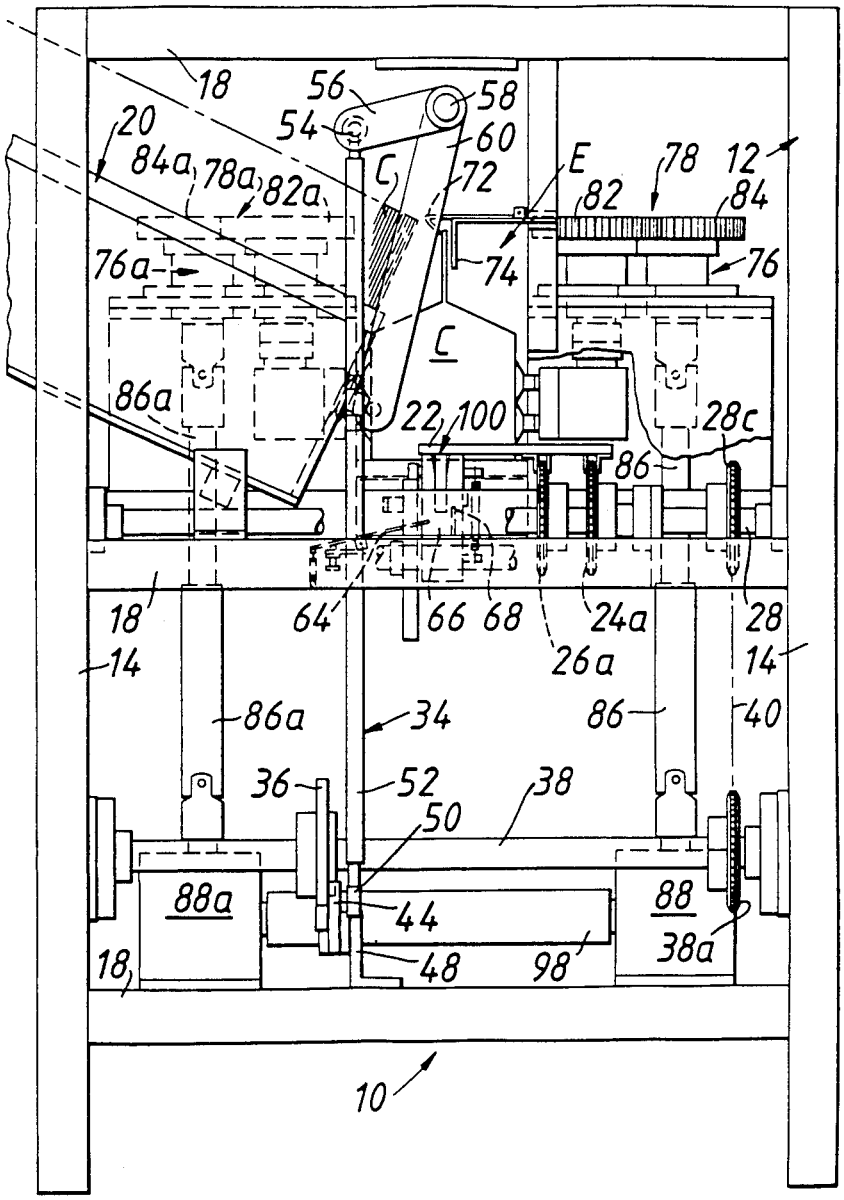
FIG. 3 is an end elevation of the machine shown in FIGS. 1 and 2.

During such withdrawal movement of a carrier the lower edge of the carrier rides over a resiliently pivotal plate 64 and locates in a lower guide channel 66 defined between the free end of the plate 64 and bracket 68. The upper edge (normally the top of a carrying handle) of the carrier also engages in an upper guide channel 70 defined by guide elements 72, 74 respectively (FIG. 3). The upper and lower guide channels maintain the collapsed carrier in an upright attitude for movement along the feed path to the erecting station 'E'.

At the erecting station, a carrier erecting assembly 76, 76*a* respectively is provided at either side of the feed path. Erecting assembly 76 includes a gear train 78 of three gears 80, 82, and 84 of which gears 80 and 82 are enmeshed with and driven by drive gear 84. Drive is transmitted to drive gear 84 by means of a vertical articulated drive shaft 86 driven through a gear box 88 from suitable drive source synchronised with a supply of carriers to the erecting station. Driven gears 80 and 82 each transmit rotational movement to an eccentric arm 90, 92 respectively, which are pivotally connected to opposite ends of a suction cup arm 94. Suction cup arm 94 carries a group of suction cups 96 each of which is connected pneumatically to a source of vacuum.

The juxtaposed erecting assembly 76*a* is of similar construction and like parts are designated like reference numerals with the addition of suffix 'a'. However, a transmission shaft 98 interconnecting the gear boxes 88 and 88*a* transmits drive to gear box 88*a*.

Rotation of the driven gears of each erecting assembly causes the suction cup arms of the respective assemblies to move towards one another so as to engage the opposed side walls of a carrier at the erecting station whilst simultaneously traversing along the feed path in the feed direction due to the eccentric relationship with respect to the driven gears. During this movement suction is applied so that the suction cups are adhered to the carrier side walls. Thereafter the suction cup arms move apart thereby opening the carrier into its erected condition as shown in FIG. 3 and this cycle of operation is repeated on the next succeeding carrier. Suction is not relieved until completion of a locking operation on the base panel of the carrier as described below. Once the carrier is opened, its base panel is engaged by a locking device to secure the base panel relative to medial upright partitions of the carrier. The locking device 100 is located at the downstream end of the erecting station.

Figure 4:
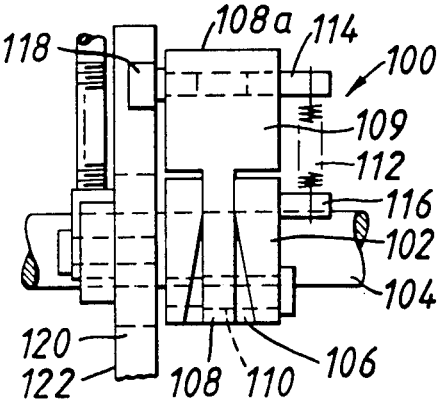
FIG. 4 is an end view of a locking device having its locking arms shown in one relative position.
Figure 5:
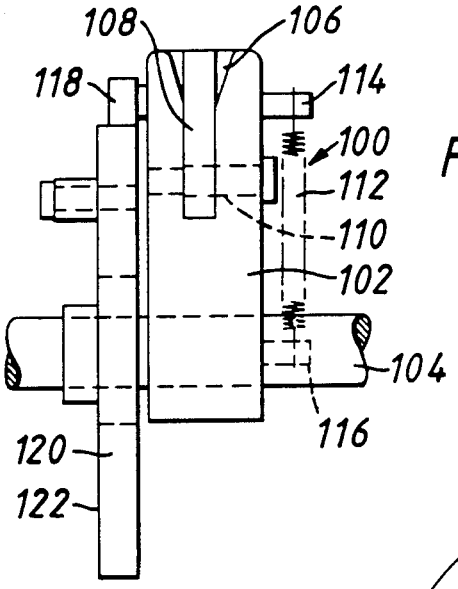
FIG. 5 is a view similar to FIG. 4 showing the locking arms in another relative position.

Referring now to FIGS. 4 and 5, the locking device 100 comprises a main locking arm 102 fixed for rotation in a circular path with rotatable shaft 104 driven from a suitable drive source in synchronism with movement of a carrier through the erecting station. At its free end the locking arm 102 is formed with a slot 106 adjacent the base of which is pivoted one end of a secondary locking arm 108 by means of pivot shaft 110. Locking arm 108 terminates in an enlarged part 109 external of the slot 106 which is resiliently connected to the main locking arm 102 adjacent shaft 104 by a coil spring 112 connected to pins 114, 116 respectively. Remote from pivot shaft 110 the enlarged part of the secondary locking arm carries a cam follower 118 which rolls around the peripheral track 120 of fixed eccentric cam 122 to control pivotal movement of arm 108 relative to rotational arm 102.

Figure 6:
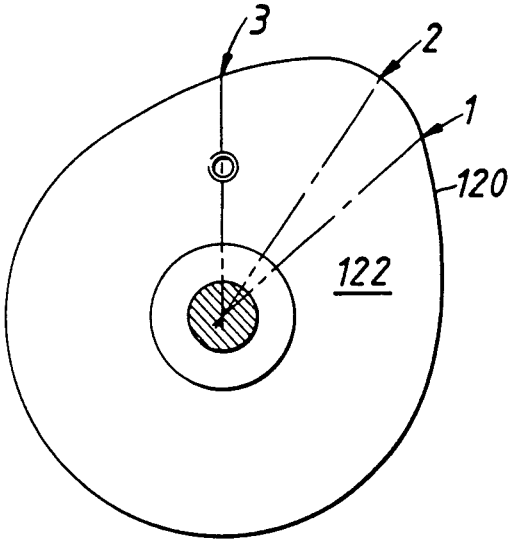
FIG. 6 is a side view of an eccentric cam for controlling movement of the secondary locking arm.
Figure 7:
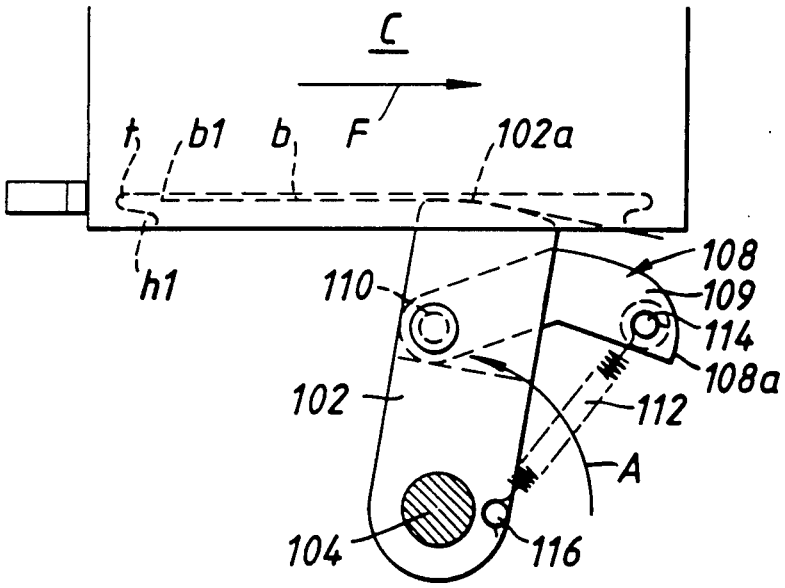
FIGS. 7 to 9 are side views showing the locking device in a number of sequential positions during its locking action.

The relative positions of the locking arms of the device 100 shown in FIG. 7 correspond to position 1 of the follower on cam track 120 (FIG. 6). At this location, the main locking arm 102 is rotated by shaft 104 into a position in which its free end 102*a* engages the base panel 'b' of carrier 'C' and wipes along base panel 'b' in a direction (arrow 'A') which moves the base panel in a direction opposed to that of the feed direction (arrow 'F') while simultaneously exerting an inwardly directed force on the base panel. This action has the effect of causing one end 'b1' of the base panel to engage in the throat 't' of a trailing locking element of the carton comprising hook 'h1'.

Figure 8:
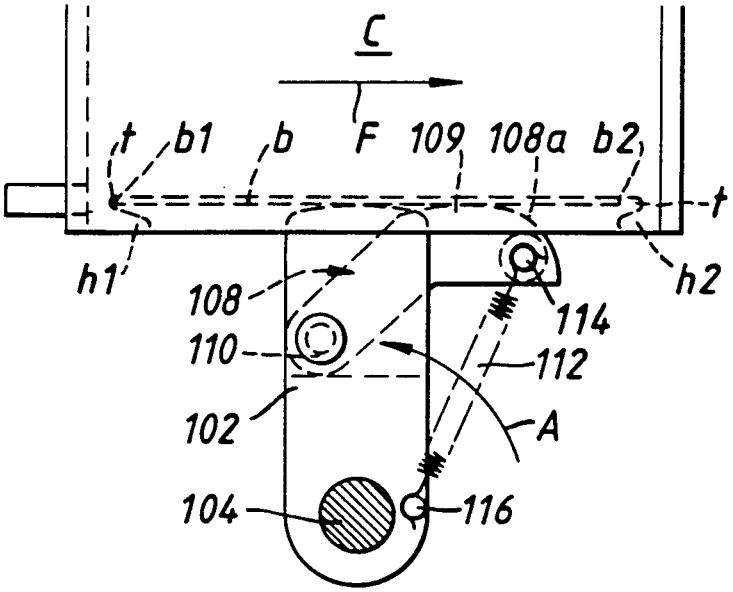

The relative positions of the locking arms 102 and 108 shown in FIG. 8 correspond to position 2 of the cam follower on cam track 120 (FIG. 6). At this location, the main locking arm 102 has its free end 102*a* approximately midway along the length of the base panel 'b' and end edge 'b1' of the base panel is fully engaged in the throat of locking hook 'h1' sufficient to provide clearance for end edge 'b2' of the base panel to pass the tip of locking hook 'h2'. Further the enlarged part 109 of the secondary locking arm 108 is pivoted upwardly relative to arm 102 into a position in which surface 108*a* of its enlarged part engages the base panel adjacent end edge 'b2' to force that end of the base panel inwardly.

Figure 9:
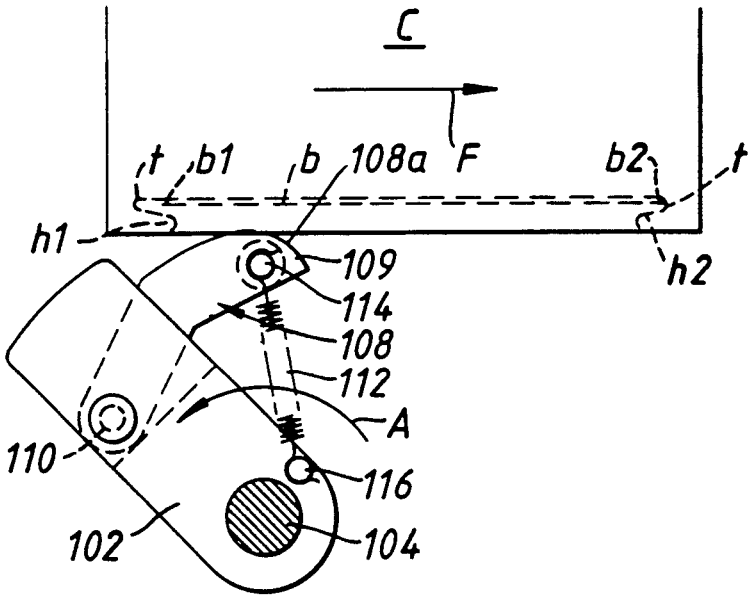

The relative positions of the locking arms 102 and 108 shown in FIG. 9 correspond to position 3 of the cam follower on cam track 120. At this location both the locking arms are rotated away from the carrier base and, once the secondary locking arm disengages from the base panel, the panel adopts a more central position relative to the carrier side walls so that its opposite end edges 'b1', 'b2' are retained by locking hooks 'h1', 'h2' respectively thereby completing the setting up process of the carrier. The base panel thereby discourages collapse of the carrier. The carrier can then be conveyed from the erecting station to a loading station where it is filled with product.

I claim:

1. A machine for erecting collapsed basket style article carriers of the type having opposed side-and end walls, medial longitudinal partitions and a base panel to be engaged with retaining elements provided adjacent both end walls so as to maintain the carrier in erected condition, which machine comprises means for withdrawing from a supply and depositing the carriers in flat collapsed condition one after the other in a feed path, means for feeding each carrier to an erecting station at which means are provided for moving apart opposing side walls of the carrier to bring it into set-up condition, locking means operable to sequentially move said base panel into engagement with the retaining elements at the trailing and leading end of the carrier, said locking means comprising a main locking arm movable in a direction opposite to the feed direction of the carrier and effective to move the trailing end of said base panel into engagement with the retaining element at the trailing end of the carrier, a secondary locking arm arranged to subsequently move the leading end of said base panel into a position in which it can move into engagement with the retaining element at the leading end of the carrier, said secondary locking arm being mounted for pivotal movement relative to said main locking arm and in the same general direction as the main locking arm.

2. The machine according to claim 1, wherein said secondary locking arm is carried on said main locking arm.

3. The machine according to claim 1, wherein pivotal movement of the secondary locking arm relative to the main locking arm is cam-controlled so that the secondary locking arm exerts an upward force against the base panel of the carrier adjacent its leading end after the trailing end of the base panel has been engaged with the retaining elements at the trailing end of the carrier.

4. The machine according to claim 3, wherein the main locking arm is rotatable mounted so that its free end describes a circular path and the secondary locking arm carries a follower arranged for movement about a fixed eccentric cam track.

* * * * *